US008640795B2

(12) United States Patent
Jekielek

(10) Patent No.: US 8,640,795 B2
(45) Date of Patent: Feb. 4, 2014

(54) SHOCK REDUCTION TOOL FOR A DOWNHOLE ELECTRONICS PACKAGE

(75) Inventor: David Jekielek, Houston, TX (US)

(73) Assignee: Technical Drilling Tools, Ltd., Houston, TX (US)

( * ) Notice: Subject to any disclaimer, the term of this patent is extended or adjusted under 35 U.S.C. 154(b) by 445 days.

(21) Appl. No.: 12/791,598

(22) Filed: Jun. 1, 2010

(65) Prior Publication Data

US 2011/0186284 A1 Aug. 4, 2011

Related U.S. Application Data

(60) Provisional application No. 61/300,205, filed on Feb. 1, 2010.

(51) Int. Cl.
*E21B 17/14* (2006.01)
*E21B 17/02* (2006.01)

(52) U.S. Cl.
USPC ..... 175/320; 166/242.6; 166/242.8

(58) Field of Classification Search
USPC ..... 175/320, 321; 166/242.6, 242.7, 242.8, 166/341
See application file for complete search history.

(56) References Cited

U.S. PATENT DOCUMENTS

| | | | | |
|---|---|---|---|---|
| 1,851,319 | A | 3/1932 | McCoy et al. | |
| 3,718,194 | A | 2/1973 | Hering et al. | |
| 3,871,193 | A | 3/1975 | Young | |
| 4,130,162 | A | 12/1978 | Nelson | |
| 4,133,516 | A * | 1/1979 | Jurgens | 267/125 |
| 4,186,569 | A | 2/1980 | Aumann | |
| 4,194,582 | A | 3/1980 | Ostertag | |
| 4,246,765 | A * | 1/1981 | Zabcik | 464/20 |
| 4,276,947 | A * | 7/1981 | Hebel | 175/321 |
| 4,413,516 | A | 11/1983 | Croom, Jr. et al. | |
| 4,512,424 | A | 4/1985 | Heemstra | |
| 4,552,230 | A | 11/1985 | Anderson et al. | |
| 4,571,215 | A | 2/1986 | Hansen | |
| 4,628,995 | A | 12/1986 | Young et al. | |
| 4,633,248 | A | 12/1986 | Small | |
| 4,706,744 | A | 11/1987 | Smith et al. | |
| 4,709,462 | A | 12/1987 | Perkin et al. | |
| 4,779,852 | A | 10/1988 | Wassell | |
| 4,844,181 | A | 7/1989 | Bassinger | |
| 5,664,891 | A | 9/1997 | Kutinsky et al. | |

(Continued)

FOREIGN PATENT DOCUMENTS

| | | | |
|---|---|---|---|
| EP | 0677640 | B1 | 9/1999 |
| EP | 2018463 | B1 | 1/2011 |
| WO | 01/88336 | A1 | 11/2001 |
| WO | 2009143300 | A2 | 11/2009 |

OTHER PUBLICATIONS

International Application No. PCT/US2011/022748 Search Report and Written Opinion dated Sep. 1, 2011.
"Toro Downhole Tools," http://www.torotools.com/html/shock_subs.html, Houston, Texas (1 p.).

(Continued)

*Primary Examiner* — Kenneth L Thompson
(74) *Attorney, Agent, or Firm* — Conley Rose, P.C.

(57) ABSTRACT

A tool string disposed in at least one tubular having upper and lower threaded connections to connect to a drill string. The tool string includes a shock reduction tool, which includes an anchoring tail piece axially and rotationally fixed to the at least one tubular. A universal bore hole orientation (UBHO) muleshoe sub is disposed at an upper end of the shock reduction tool. A downhole electronics package coupled to the UBHO muleshoe sub.

23 Claims, 10 Drawing Sheets

(56) References Cited

U.S. PATENT DOCUMENTS

| | | | | |
|---|---|---|---|---|
| 5,769,558 | A | 6/1998 | Jekielek | |
| 6,098,726 | A | 8/2000 | Taylor et al. | |
| 6,332,841 | B1 | 12/2001 | Secord | |
| 6,412,614 | B1 | 7/2002 | Lagrange et al. | |
| 7,044,219 | B2 | 5/2006 | Mason et al. | |
| 7,681,637 | B2 * | 3/2010 | Frazier et al. | 166/242.8 |
| 7,845,405 | B2 * | 12/2010 | Villareal et al. | 166/264 |
| 2009/0023502 | A1 | 1/2009 | Koger | |

OTHER PUBLICATIONS

Oberg, Erik, et al., "Polygon Shafts," Machinery's Handbook, 23rd Edition, Third Printing, 1990, Industrial Press, Inc., Philadelphia, Pennsylvania, p. 2047-2048 (4 p.).

Office Action Dated Jul. 8, 2013; Colombian Application No. 12-149283 (4 p.).

English Summary of Office Action Dated Jul. 8, 2013; Colombian Application No. 12-149283 (2 p.).

* cited by examiner

SHOCK REDUCTION TOOL FOR A DOWNHOLE ELECTRONICS PACKAGE

CROSS-REFERENCE TO RELATED APPLICATIONS

The present application claims the benefit of priority to U.S. Provisional Patent Application No. 61/300,205 filed on Feb. 1, 2010, which is incorporated herein by reference in its entirety for all purposes.

BACKGROUND

Downhole tools are subjected to substantial forces and vibration during drilling. Sensor packages and other sensitive downhole electronics, such as those housed in measurement-while-drilling (MWD) tools, steering tools, gyros, or logging-while-drilling (LWD) tools, are particularly vulnerable to damage from vibration and shock during drilling. Electronics in downhole tools are often mounted in ways that reduce the vibration and shock that is felt by the electronics, but ultimately the vibration and shock still reduce the life cycle of the electronics and add fatigue and wear to the bottom hole assembly. Reducing shock and vibration felt by the electronics extends their life cycle, which saves valuable time and money that would be spent replacing or repairing the directional sensors and electronics. Accordingly, additional measures to minimize shock and vibration that reaches electronics are valuable.

BRIEF DESCRIPTION OF THE DRAWINGS

For a more detailed description of the embodiments, reference will now be made to the following accompanying drawings.

DETAILED DESCRIPTION OF THE DISCLOSED EMBODIMENTS

The present disclosure relates to a shock and vibration reduction tool (hereinafter "shock reduction tool") for downhole tools with electronic or sensitive mechanical components. The drawings and the description below disclose specific embodiments with the understanding that the embodiments are to be considered an exemplification of the principles of the invention, and are not intended to limit the invention to that illustrated and described. Further, it is to be fully recognized that the different teachings of the embodiments discussed below may be employed separately or in any suitable combination to produce desired results. The term "couple," "couples," or "coupled" as used herein is intended to mean either an indirect or a direct connection. Thus, if a first device couples to a second device, that connection may be through a direct connection; e.g., by conduction through one or more devices, or through an indirect connection; e.g., by convection or radiation. "Upper" or "uphole" means towards the surface (i.e. shallower) in a wellbore, while "lower" or "downhole" means away from the surface (i.e. deeper) in the wellbore.

Figure 1:
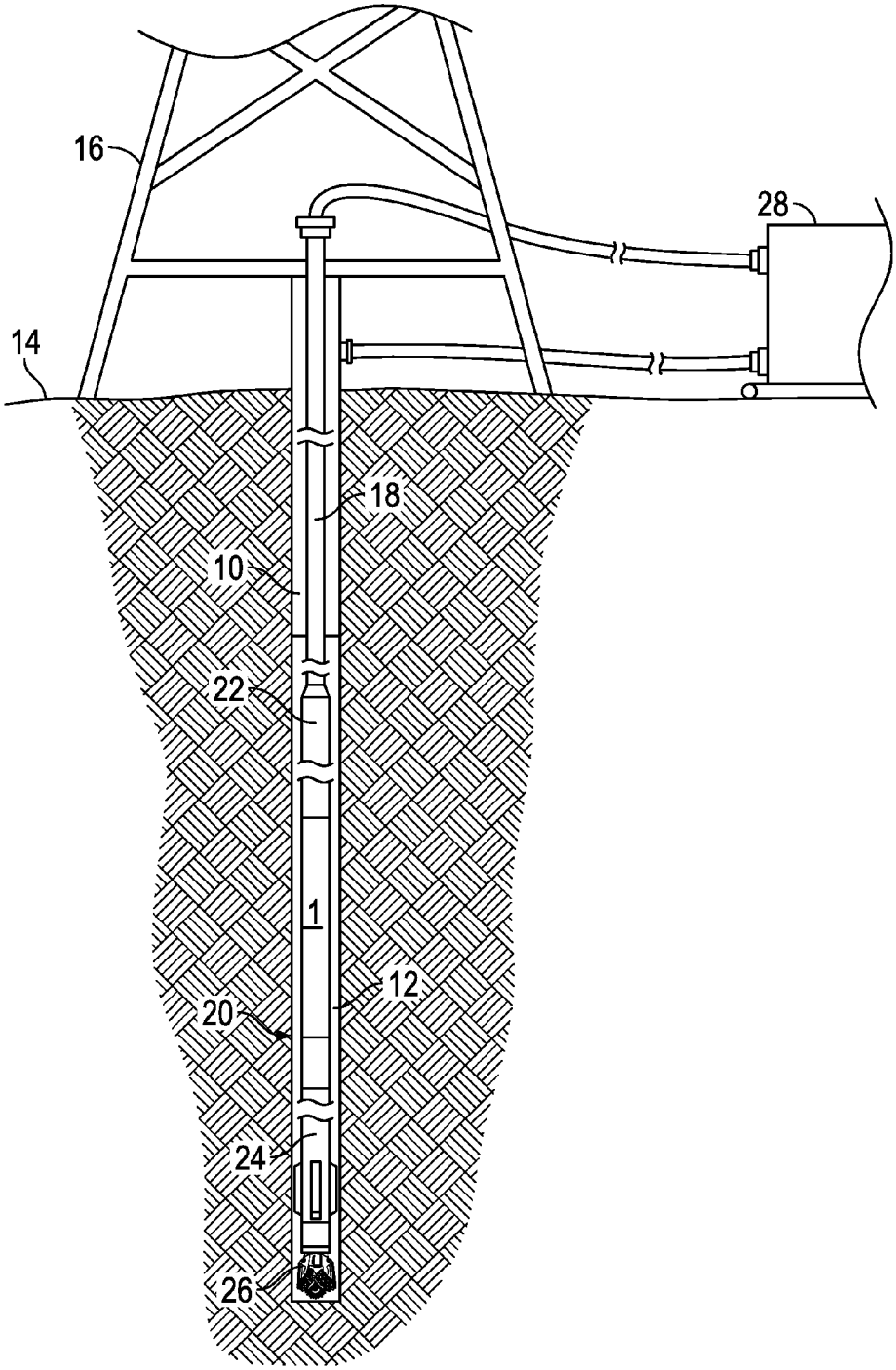
FIG. 1 is a schematic representation of a drilling system including a downhole tool with a shock reduction tool according to the principles disclosed herein.

Referring now to FIG. 1, a drill string 10 is suspended in a wellbore 12 and supported at the surface 14 by a drilling rig 16. The drill string 10 includes a drill pipe 18 coupled to a downhole tool assembly 20. The downhole tool assembly 20 includes multiple (e.g., twenty) drill collars 22, a measurement-while-drilling (MWD) tool assembly 1, a mud motor 24, and a drill bit 26. The drill collars 22 are connected to the drill string 10 on the uphole end of the drill collars 22, and the uphole end of the MWD tool assembly 1 is connected to the downhole end of the drill collars 22, or vice versa. The uphole end of the mud motor 24 is connected to the downhole end of MWD tool assembly 1. The downhole end of the mud motor 24 is connected to drill bit 26.

The drill bit 26 is rotated by rotary equipment on the drilling rig 16 and/or the mud motor 24 which responds to the flow of drilling fluid, or mud, which is pumped from a mud tank 28 through a central passageway of the drill pipe 18, drill collars 22, MWD tool assembly 1 and then to the mud motor 24. The pumped drilling fluid jets out of the drill bit 26 and flows back to the surface through an annular region, or annulus, between the drill string 10 and the wellbore 12. The drilling fluid carries debris away from the drill bit 26 as the drilling fluid flows back to the surface. Shakers and other filters remove the debris from the drilling fluid before the drilling fluid is recirculated downhole.

The drill collars 22 provide a means to set weight off on the drill bit 26, enabling the drill bit 26 to crush and cut the formations as the mud motor 24 rotates the drill bit 26. As drilling progresses, there is a need to monitor various downhole conditions. To accomplish this, the MWD tool assembly 1 measures and stores downhole parameters and formation characteristics for transmission to the surface using the circulating column of drilling fluid. The downhole information is transmitted to the surface via encoded pressure pulses in the circulating column of drilling fluid.

Figure 6:
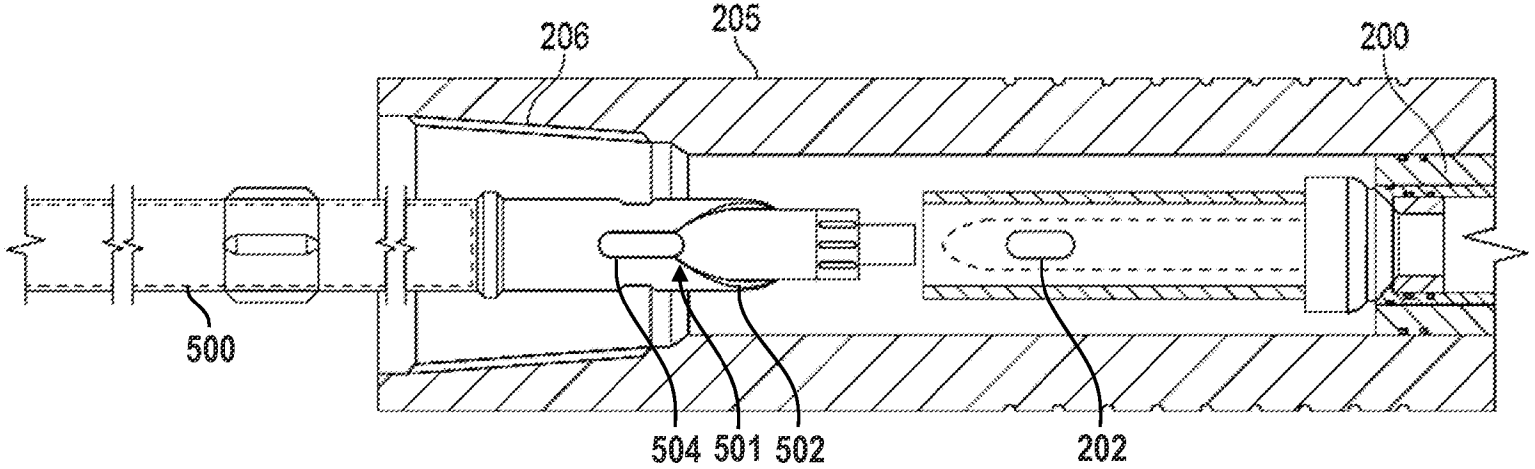
FIG. 6 is a schematic, partial cross-sectional illustration of a downhole electronics package being received within a universal bore hole orientation (UBHO) mule shoe.

FIGS. 2A-2D are cross-sectional views of a shock reduction tool for a downhole electronics package, such as a gyro, electronics within a MWD (e.g., MWD 1), steering tool, or LWD tool. Such tools are typically oriented and fixed within a section of drill collar using a universal bore hole orientation mule shoe 200 (commonly known as a "UBHO"), which is incorporated into the shock reduction tool shown in FIGS. 2A-2D. In the prior art, the UBHO 200 axially and rotationally fixes the downhole electronics package within the drill collar. For example, referring briefly to FIG. 6, a downhole electronics package 500 (e.g., MWD, steering tool, gyro, LWD tool, etc.) is shown being received within UBHO 200. The lower end of the electronics package 500 is provided with a profile 501 that mates and slidingly engages a radially extending key 202 of the UBHO 200 to axially position and rotational oriented the electronics package 500 within and relative to 501. More specifically, profile 501 includes a pair of helical guide surfaces 502 that taper to a receptacle or slot 504. As electronics package 500 is lowered into UBHO 200, guide surface(s) 502 slidingly engage key 202 and guide key 202 into slot 504, thereby axially positioning and rotationally orienting electronics package 500 within and relative to 501. Embodiments of the present disclosure incorporate the UBHO 200 into a shock reduction tool assembly that maintains the angular orientation of the collar-mounted downhole electronics package while allowing for axial travel to absorb shock and vibration during drilling and other downhole operations.

Figure 2A:
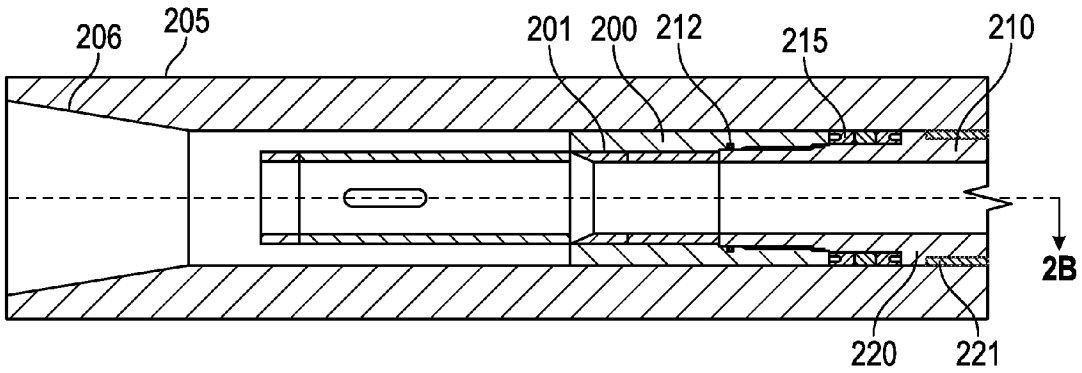
FIGS. 2A-2D are cross-sectional views of a shock reduction tool according to the principles disclosed herein.
Figure 2B:
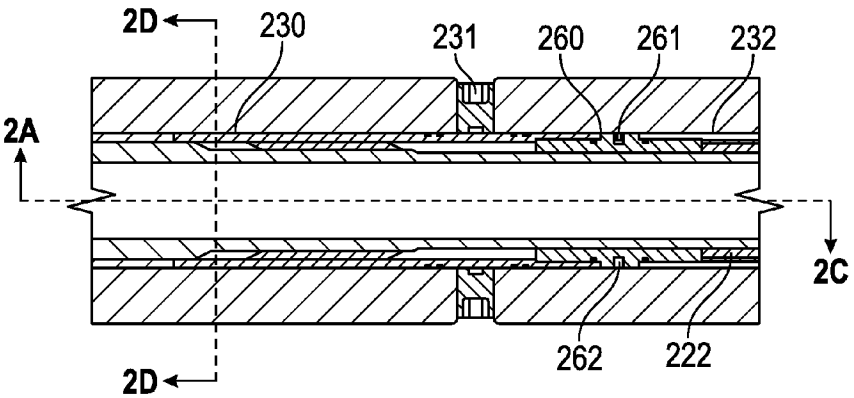
Figure 2C:
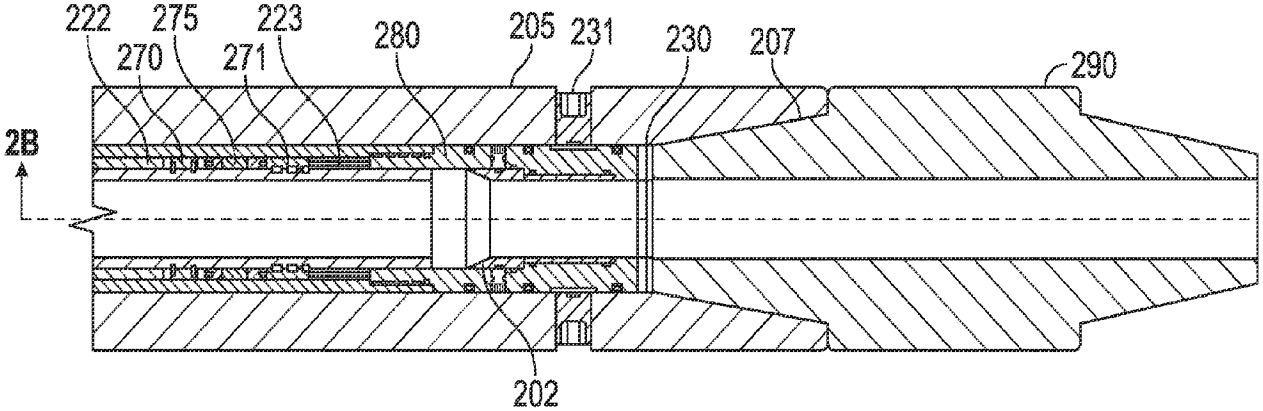

The shock reduction tool shown in FIGS. 2A-2D will now be described in detail. Those having ordinary skill in the art will appreciate that individual design features in the illustrated embodiment may be altered or eliminated without departing from the scope of the present disclosure. Starting with the upper end of the shock reduction tool shown in FIG. 2A, the shock reduction tool is disposed in a drill collar 205 with threaded connections 206, 207 (Note: only threaded connection 206 is shown in FIG. 2A) to allow connection to other tubular components in the drill string. At the upper end, the UBHO 200 is connected to an oriented adapter 210. The connection between the UBHO 200 and the oriented adapter 210 may be a threaded connection as shown in FIG. 2A and include an O-ring 212 or other seal. The UBHO 200 may also include a flow orifice and bottom sleeve 201 features to direct fluid towards the center of the oriented adapter 210 as the fluid flows past the downhole electronics package (not shown), through the UBHO 200, and into the inner bore of the oriented adapter 210. The bottom sleeve 201 may be formed of a hard, wear-resistant material, such as carbide. The bottom sleeve 201 serves as a sacrificial wear item to reduce erosion of other components downstream that can be caused by the high flow rates and associated turbulence of drilling fluid.

A seal 215 may be disposed between outer surface of the oriented adapter 210 and the inner bore of the drill collar 205 to prevent drilling fluid from migrating into the components of the shock reduction tool housed between the oriented adapter 210 and the drill collar 205. The seal 215 is held axially in place between the end of the UBHO 200 and a shoulder 220 formed on the outside of the oriented adapter 210. A spring 221 is located on the opposite side of the shoulder 220. Moving to FIG. 2B, the spring 222 is axially held in place between the shoulder 220 and the upper end of an orienting sleeve 230. The orienting sleeve 230 is axially and rotationally fixed relative to the drill collar 205. In this embodiment, the orienting sleeve 230 is held in place, in part, by set screws 231. The orienting sleeve 230 is also held in place by its relationship with other components in the shock reduction tool, as will be explained in further detail.

Figure 2D:
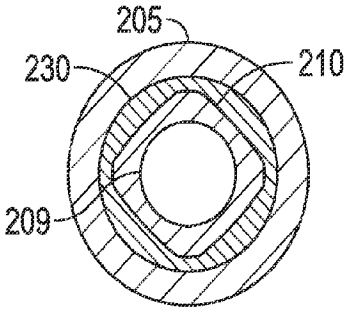

The orienting sleeve 230 and the oriented adapter 210 share mating features that substantially maintain their rotational orientation while allowing for relative axial movement. In some embodiments, the rotational orientation may be maintained by splines or keys. In the illustrated embodiment, a four-sided (PC4) polygon is used to maintain the relative orientation of the orienting sleeve 230 and the oriented adapter 210, as shown in FIG. 2D. The oriented adapter 210 has the male PC4 polygon and the orienting sleeve 230 has the corresponding female profile. The PC4 polygon profile provides substantial resistance to torque while allowing for a bore 209 to be formed through the oriented adapter 210. The bore 209 is able to be made larger than it otherwise would be if other orienting features were used.

The lower end of the orienting sleeve 230 is connected to an adapter 260 by a threaded connection. The adapter 260 may include a lubricating port 261 for injecting grease, oil, or other lubricating fluids into the shock reduction tool. To aid with making up the threaded connections, the adapter 260 may further include a spanner feature 262 to allow for the use of a spanner wrench while assembling the shock reduction tool. On its lower end, the adapter 260 is connected to a lower sleeve 232 by another threaded connection. A second spring 222 is disposed between the adapter 260 and a load spacer 270. The load spacer 270 may be held in place by snap rings or other locking mechanisms to axially fix the load spacer 270 to the oriented adapter 210. A seal 275 may be disposed below the load spacer 270 to seal between the oriented adapter 210 and the lower sleeve 232.

Another load spacer 271 may be disposed below the seal 275 to hold the seal 275 in place and provide a shoulder for spring 223 to act against. The load spacer 271 may be threaded onto the oriented adapter 210 or held in place by other generally known locking mechanisms. A third spring 223 is disposed between the load spacer 271 and an anchoring tail piece 280. The anchoring tail piece 280 is connected to the lower sleeve 232 by a threaded connection. Another fluid diverter 202 may be disposed inside the anchoring tail piece 280 to reduce erosion of the anchoring tail piece 280. The anchoring tail piece 280 is held in place relative to the drill collar 205 by set screws 231. Various O-rings or other seals are provided between the anchoring tail piece 280 and other components to prevent the migration of drilling fluid into the shock reduction tool. For precision in axially locating the shock reduction tool and the downhole electronics package, shim(s) 291 may be used between the anchoring tail piece 280 and a pin-to-pin crossover sub 290. The shim(s) 291 also allow for the drill collar 205 to have threaded connection 207 re-cut by providing an adjustable axial distance between the anchoring tail piece 280 and the pin-to-pin crossover sub 290. In the embodiment shown in FIGS. 4A-4D, both threaded connections 206, 207 of the drill collar 205 are box connections for ease of manufacture and assembly. With two box connections, the drill collar 205 can be manufactured with a substantially continuous bore. The pin-to-pin crossover sub 290 allows for the shock reduction tool to be packaged with the traditional box-up/pin-down practice used in assembling drill strings.

The function of the shock reduction tool embodiment shown in FIGS. 2A-2D will now be described. As discussed above, the downhole electronics package will be connected to the UBHO 200 at the upper end of the shock reduction tool. The various orienting features of the shock reduction tool will substantially maintain the angular orientation of the downhole electronics package determined during the installation. The UBHO 200, and, by extension, the downhole electronics package are able to move axially with the oriented adapter 210 relative to the drill string. Shock and vibration from the drill string are dampened by the springs 221, 222, and 223. In the particular configuration shown in FIGS. 2A-2D, the springs 221 and 223 act in the same direction while spring 222 opposes the force from springs 221 and 223. For example, an upward shock from the drill string would cause drill collar 205 to move upward relative to the downhole electronics package. This relative movement would compress springs 221 and 223 while spring 222 would extend. The result is that less shock is transmitted to the downhole electronics package from the drill string. Those having ordinary skill in the art will appreciate that more or less than three springs may used without departing from the scope of the disclosure. The desired spring rate of the springs (and the corresponding design and material) may vary according to the weight of the downhole electronics package and downhole conditions. The springs may be, for example, helical springs, crest-to-crest wave springs, nested wave springs, and/or stacks of Belleville washers.

Those having ordinary skill in the art will appreciate that various individual components described above as being separate may be combined according to design preferences without departing from the scope of the present disclosure. Further, various components with multiple design features that are combined may be separated into discrete components. For example, the orienting sleeve 230 could be combined with the adapter 260 and the lower sleeve 232, or, alternatively, those sleeves may be separated into multiple connected sleeves. In another example, the oriented adapter 210 can also be separated into multiple components according to design and manufacturing preferences.

The embodiment of a shock reduction tool illustrated in FIGS. 2A-2D provides a relatively simple and low maintenance way to reduce the shock and vibration experienced by downhole electronics packages. By virtue of incorporating the widely accepted UBHO 200, the shock reduction tool is easily added to existing drill string designs. Assembly of the various interior components can be carried out in a series from end to end and then placed fully assembled into the drill collar 205. The internal components of the shock reduction tool can be kept lubricated by pumping lubricant into port 261 and then closing port 261. The lubricant will migrate from the port 261 between the orienting features of the oriented adapter 210 and the orienting sleeve 230, the cavities for the springs 221, 222, and 223, and into the other sliding interfaces contained within the shock reduction tool housed within the drill collar 205. After placement into the drill collar 205, the drilling personnel need only to make-up the well-known threaded connections to the drill string where they would normally place the drill collar for the downhole electronics package. Determining the orientation of the downhole electronics package can be carried out as normal with the only change being a few set screws.

Figure 3A:
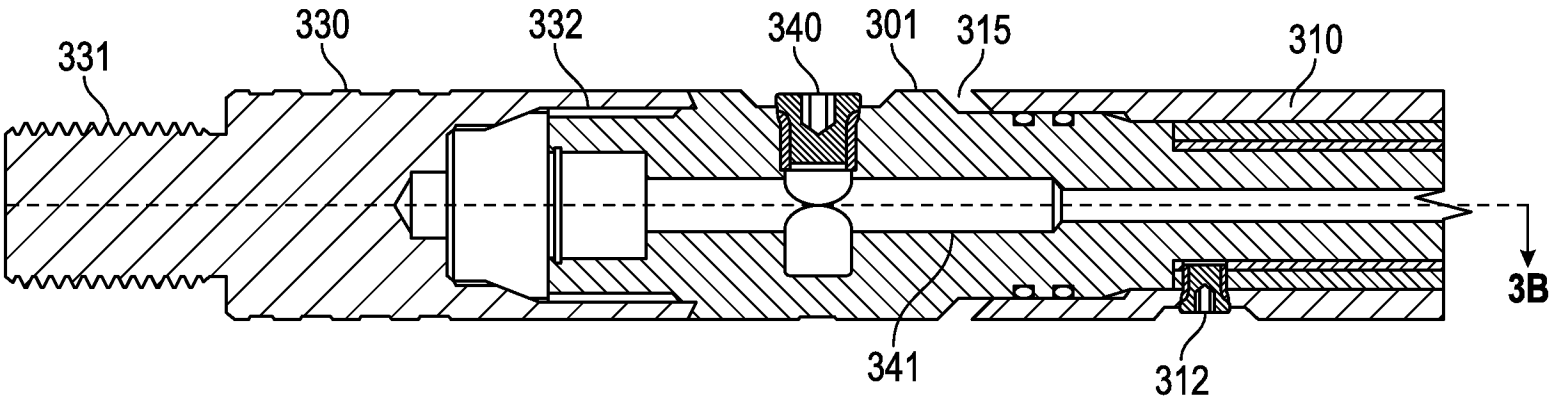
FIGS. 3A-3C are cross-sectional views of a shock reduction tool according to the principles disclosed herein.
Figure 3B:
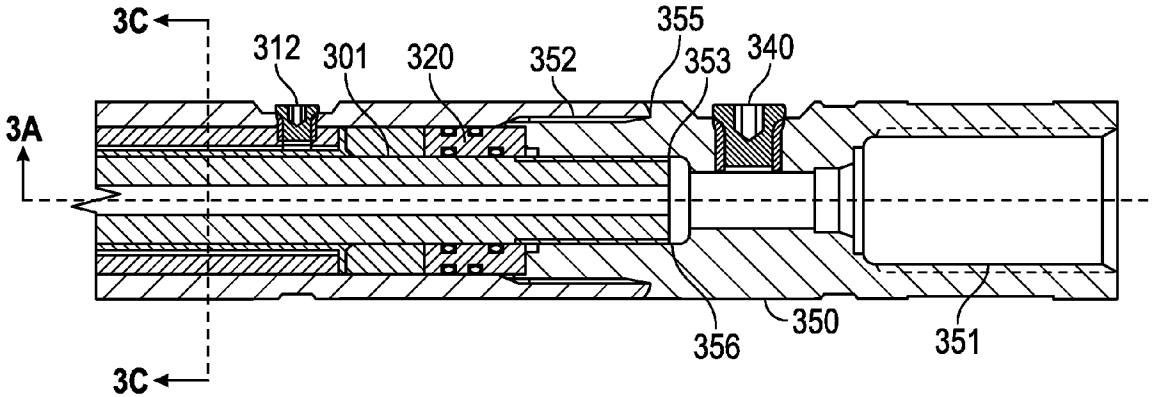
Figure 3C:
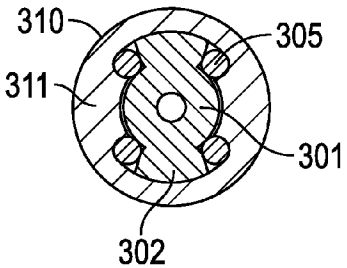

In FIGS. 3A-3C, another shock reduction tool embodiment is shown. The shock reduction tool shown in FIGS. 3A-3C is designed to reduce torsional shock experienced by downhole electronics. As formation strength increases, more weight on bit (WOB) is often required to maintain efficient depths of cut by the drill bit. Increased WOB will often create "stick-slip," a violent reaction to built up torsional energy along the length of the drill string. By definition, drill bit stick-slip vibration involves periodic fluctuations in drill bit rotational speed, ranging from zero to more than five times the rotational speed measured at the surface on the rig floor. During the "stick" period, the drill bit stops drilling while WOB and torque on bit (TOB) are still applied. As the rotary table or top drive on the rig floor continues to turn, the resulting torque loading on the drill string will cause the drill bit to eventually give way or "slip," causing a significant increase in its rotational speed. When mud motors are utilized, the stick slip torsional wave to the surface is reduced but still imparts damaging vibrations to the downhole electronics package. The shock reduction tool shown in FIGS. 3A-3C reduces the torsional vibration experienced by downhole electronics housed within the drill collar. Orientation of the downhole electronics within the drill collar is maintained by orienting features within the shock reduction tool.

The shock reduction tool shown in FIGS. 3A-3C will now be described in detail. Those having ordinary skill in the art will appreciate that individual design features in the illustrated embodiment may be altered or eliminated without departing from the scope of the present disclosure. Starting with the lower end of the shock reduction tool shown in FIG. 3A, the shock reduction tool has a lower connection piece 330 with a threaded connection 331 for connecting to a downhole electronics package or an orienting device. The upper end of the lower connection piece 330 includes a threaded connection 332 that connects to an oriented shaft 301. The oriented shaft 301 is received within an oriented housing 310.

FIG. 3C shows a cross-section of the interface between the oriented shaft 301 and oriented housing 310 that provides torsional shock reduction. The oriented shaft 301 includes two or more splines 302 projecting radially outward. The oriented housing 310 includes corresponding splines 311 projecting radially inward. Resilient chords 305 are disposed in the gaps between the splines 302 and splines 311. The resilient chords 305 allow for a limited amount of relative rotation between the oriented shaft 301 and the oriented housing 310. Material for the resilient chords 305 may be selected according to a desired durometer and the conditions expected downhole. Resilient materials may include RTV silicone, butyl rubber, urethane, and nitrile rubber, for example. The resilient chords may be cylindrical pieces of material, such as a cut O-ring, that are laid in place between the splines 302, 311 during assembly of the shock reduction tool. Alternatively, the resilient chords 305 may be potted in the gaps between the splines 302, 311 by injecting uncured resilient material in ports 312 in the oriented housing 310, which are located at opposing ends of the splines 311. The resilient material will bond to the splines 302, 311. In one embodiment, a releasing agent may be applied to splines 302 and/or splines 311 so that the resilient material bonds to one or none of the set of splines, which allows for later removal of the oriented shaft 301 from the oriented housing 310 without damaging the potted resilient material.

Continuing with FIG. 3B, a pressure-balancing piston 320 may be disposed between the oriented shaft 301 and the oriented housing 310. The pressure-balancing piston 320 is limited in axial travel by the splines 301, 311 and a lower connection piece 350. The upper end of the oriented shaft 301 includes a male thread 353 and the lower end of the oriented housing 310 includes a female thread 352. For ease of assembly, threads 353, 352 may have substantially the same pitch so that the lower connection piece 350 threads onto the oriented shaft 301 and into the oriented housing 310 at the same time. A gap 315 between the upper end of the housing 310 and a shoulder on the oriented shaft 301 helps to time the threading of the two connections. The oriented housing 310 is threaded on until shoulders 355 contact. At that time, an axial gap 356 will remain between the end of the oriented shaft 301 and the lower connection piece 350. This will allow for the oriented shaft 301 to rotate relative to the oriented housing 310 and the upper connection piece 350.

At its upper end, the upper connection piece 350 includes a threaded connection 351. In one embodiment, the threaded connection 351 is for connecting to another shock reduction tool configured to reduce axial shock and vibration. One example of a shock reduction tool that may be used with embodiments of the present disclosure is the ELIMINATOR HYDRAULIC SHOCK TOOL available from THRU TUBING RENTAL ("TTR") (Houston, Tex.). In one embodiment, lubricant ports 340 may be provided in the oriented shaft 301 and/or the upper connection piece 350. Lubricant, such as oil or grease, may be injected into a central bore 341. The injected lubricant may be allowed to flow through the central bore to the other shock reduction tool connected to the lower connection piece 332.

In the embodiment shown in FIGS. 3A-3C, torsional shock reduction is provided by the relative rotation allowed between the oriented shaft 301 and the oriented housing 310. Torsional shock from the drill string travels through the any intervening components to the upper connection piece 350 and the oriented housing 310, which is rotationally fixed to the upper connection piece 350. Due to gap 356 between the end of the oriented shaft 301 and the upper connection piece 350, the oriented shaft 301 is not rotationally fixed to the oriented housing 310 and the upper connection piece 350. The relative rotation between the oriented shaft 301 and the oriented housing 310 is limited by resilient chords 305 and the gap between the splines 302 and splines 311. To maintain general orientation of the downhole electronics package, relative rotation may be limited to less than about 10 degrees. In one embodiment, relative rotation is limited between about 5 degrees and 8 degrees. The resilient chords 305 between the splines 302 and splines 311 absorb at least some of the torsional shock from the oriented housing 310 instead of communicating it to the oriented shaft 301. The downhole electronics package is rotationally fixed to the upper connection piece 350 in order to benefit from the reduced torsional shock.

Figure 4A:
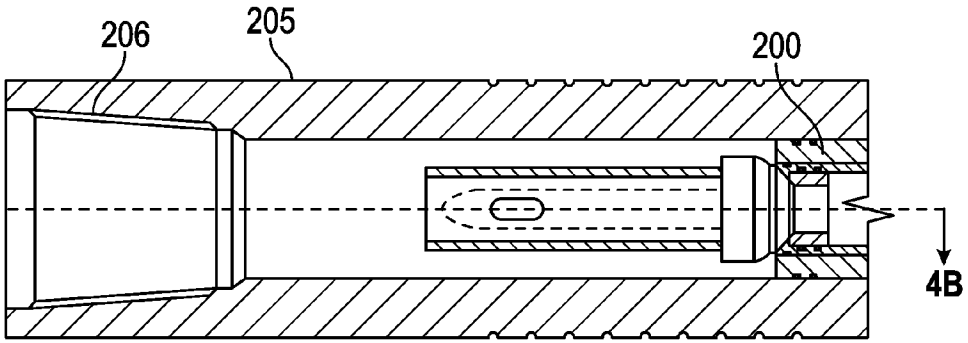
FIGS. 4A-4F are cross-sectional views of a shock reduction tool according to the principles disclosed herein.
Figure 4B:
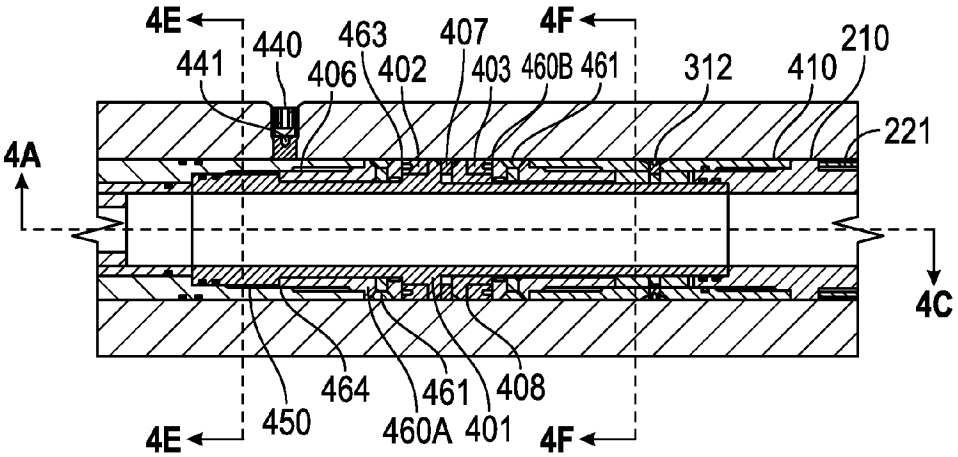
Figure 4C:
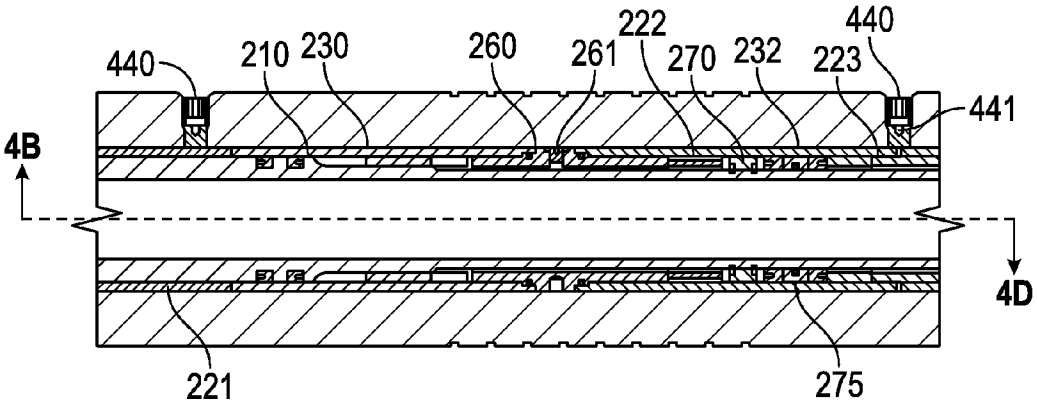

In FIGS. 4A-4F, a shock reduction tool in accordance with another embodiment is shown. In this embodiment, the shock reduction tool includes a torsional shock reduction section (FIG. 4B) and an axial shock reduction section (FIG. 4C). Torsional shock reduction is provided in a manner similar to the embodiment shown in FIGS. 3A-3C. Axial shock reduction is provided in a manner similar to the embodiment shown in FIGS. 2A-2D. For clarity, the same reference numerals are used from the prior embodiments for corresponding features in the embodiment of FIGS. 4A-4F.

Figure 4E:
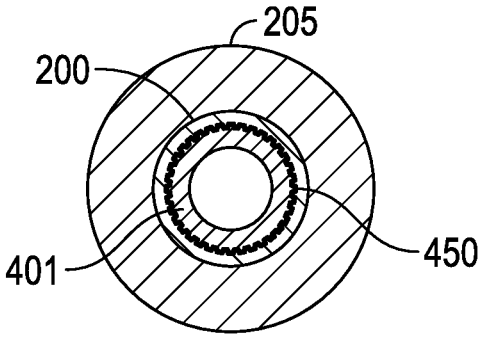
Figure 5:
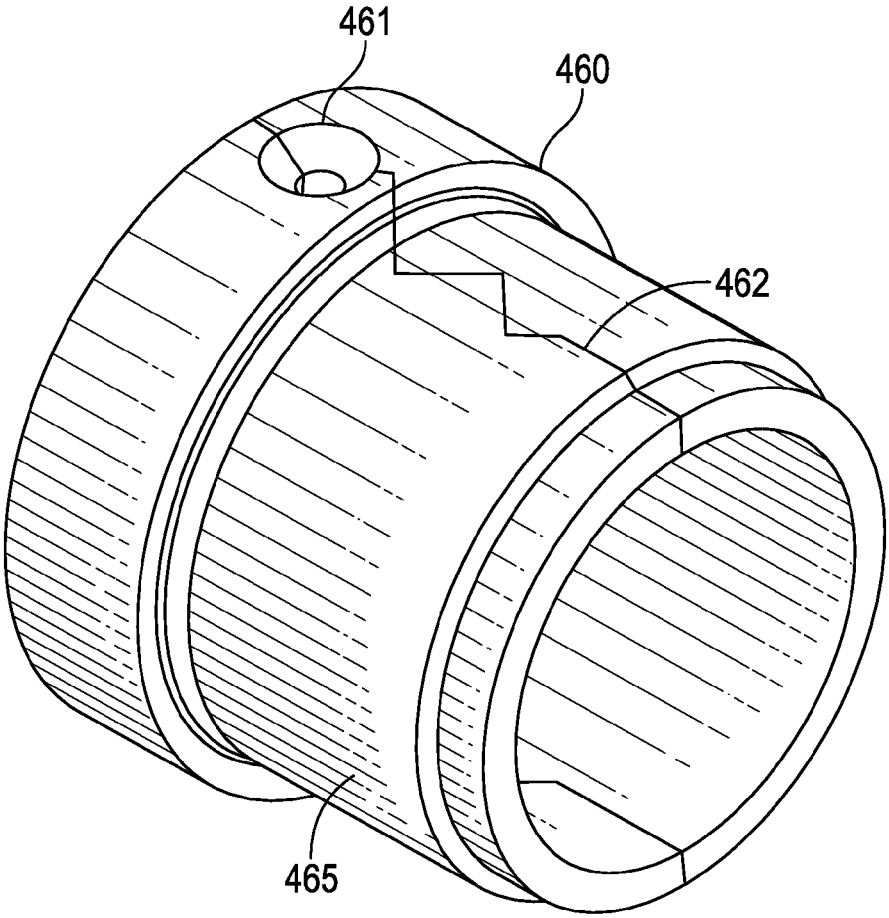
FIG. 5 is an isometric view of a threaded ring component of a shock reduction tool according to the principles disclosed herein.

At the upper end, the shock reduction tool includes the UBHO 200 that connects to the torsional shock reduction section shown in FIG. 4B. The torsional shock reduction section includes an oriented shaft 401. A threaded ring 460A couples the UBHO 200 to the oriented shaft 401. The threaded ring 460A is split into at least two pieces so that it can be assembled around the oriented shaft 401, axially trapped between shoulders 463 and 464. The UBHO 200 includes a threaded section 406 corresponding to the threaded ring 460A. To provide angular orientation between the UBHO 200 and the oriented shaft 401, both components include corresponding splined portions 450, which are illustrated in FIG. 4E. For assembly, the threaded ring 460A is placed on the oriented shaft 401. The corresponding splined portions 450 of the UBHO 200 and the oriented shaft 401 are brought together as the threaded ring 460A is rotated. Rotating the threaded ring 460A to engage the threaded section 406 of the UBHO 200 draws the UBHO 200 towards the oriented shaft 401 while staying rotationally fixed relative to the oriented shaft 401 due to the corresponding splined portions 450. The threaded ring 460 is separately illustrated in FIG. 5. To lock the assembly, the threaded ring 460A includes radial screw holes 461. The split 462 for the threaded ring 460A may cut across the radial screw holes 461 so that tightening screws into the radial screw holes 461 forces the sections of the threaded ring 460 radially outward, which locks the threaded section 406 of the UBHO sub 200 to threaded section 465 on the threaded ring 460A.

The oriented shaft 401 further includes an outer shoulder 408 that holds seals 402, 403. The outer shoulder 408 also may include lubrication ports 407 to allow oil or grease to be injected into the torsional shock reduction section. A second threaded ring 460B is used to couple the oriented housing 410 to the oriented shaft 401 in essentially the same manner as described with respect to the UBHO sub 200 and the threaded ring 460A. Similar to the embodiment shown in FIGS. 3C, the oriented shaft 401 includes outwardly facing splines 409 corresponding to inwardly facing splines 411 on the oriented housing 410, as shown in FIG. 4F. Resilient chords 305 are disposed in the gaps between splines 409, 411 to reduce torsional shock transmitted from the oriented housing 410 to the oriented shaft 401. The resilient chords 305 may be injected in an uncured state through ports 312 or laid in place as strips during assembly of the shock reduction tool. The oriented housing 410 also connects the torsional shock reduction section to the oriented shaft 210 of the axial shock reduction section shown in FIG. 4C. The axial shock reduction section shown in FIG. 4C functions and is assembled in a manner similar to what is described with respect to the embodiment of FIGS. 2A-2D.

Figure 4D:
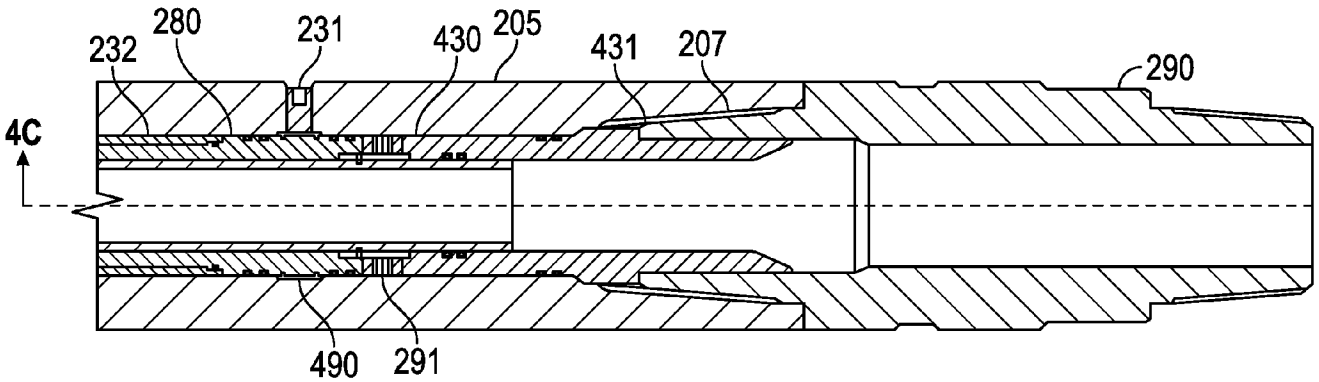
Figure 4F:
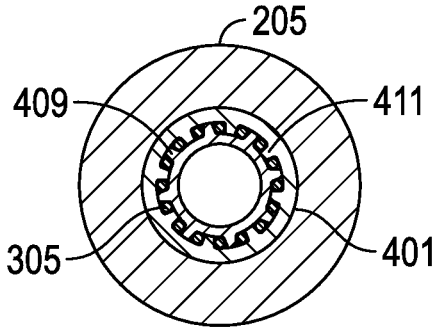

FIG. 4D shows the lower end of the axial shock reduction section. The lower sleeve 232 is threadably connected to anchoring tail piece 280. The anchoring tail piece is held in place by two set screws 231 at 90 degree angles apart. For better holding by the set screws 231, the anchoring tail piece may include a knurled band 490. Between the anchoring tail piece 280 and pin-to-pin crossover sub 290, a flow sleeve 430 may be provided. Flow sleeve 430 provides a smooth transition for drilling fluid from the shock reduction tool to the pin-to-pin crossover sub 290 and subsequently the rest of the drill string below. The flow sleeve 430 may be held in place by trapping an outward shoulder 431 between the drill collar 205 and the pin-to-pin crossover sub 290.

With the shock reduction tool installed within the drill collar 205, parts of the assembly may be lubricated with oil or grease through lubrication fittings 441. The lubrication fittings 441 may be protected from erosion by a secondary screw 440. Through the lubrication fittings 441, the oil or grease can work its way between the inside of the drill collar and the various components of the shock reduction tool.

Embodiments of the shock reduction tool disclosed herein may be used in conjunction with a shock sub that is incorporated into the drill string below the drill collar that contains the downhole electronics package. Shock subs are often employed above the drill bit to absorb shock and vibration and keep the drill bit against the formation being drilled. In one embodiment, the shock reduction tool is tuned to take into account the characteristics of the shock sub located below. For example, with the shock sub absorbing stronger impacts, the shock reduction tool may have use lighter springs to absorb and dampen the smaller shocks. Additionally, the shock reduction tool can be tuned to have complimentary dampening to the shock sub in order to avoid harmonic resonances during operation.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A shock reduction tool for a downhole electronics package, comprising:

an anchoring tail piece configured to be rotationally and axially fixed within a tubular, wherein upper and lower ends of the tubular are configured to connect to a drill string;

an orienting sleeve comprising a female angular orientation feature;

an oriented adapter rotationally fixed and axially movable with respect to the orienting sleeve, wherein the oriented adapter comprises a through bore and a male angular orientation feature adapted to the orienting sleeve;

a universal bore hole orientation (UBHO) muleshoe disposed at an upper end of the oriented adapter and configured to rotationally and axially orient the downhole electronics package within the tubular; and a first spring disposed in an annular space between the oriented adapter and the orienting sleeve, wherein the spring is between a first shoulder that is axially fixed to the oriented adapter and a second shoulder that is axially fixed to the orienting sleeve, wherein one of the orienting sleeve and the orienting adapter is rotationally and axially fixed relative to the anchoring tail piece.

2. The shock reduction tool of claim 1, wherein the male and female angular orientation features comprise a PC4 polygon.

3. The shock reduction tool of claim 1, wherein the shock reduction tool comprises a second spring configured to apply force in an opposing direction to the first spring.

4. The shock reduction tool of claim 1, further comprising:

a torsional shock reduction section, comprising, an oriented housing, and an oriented shaft rotationally movable by less than about 10 degrees with respect to the oriented housing, wherein one of the oriented shaft and the oriented housing is rotationally and axially fixed with respect to the oriented adapter.

5. The shock reduction tool of claim 4, wherein the torsional shock reduction section is disposed between the oriented adapter and the UBHO muleshoe.

6. The shock reduction tool of claim 5, wherein the UBHO muleshoe is axially fixed to the oriented shaft by a threaded ring disposed between two shoulders on the oriented shaft.

7. The shock reduction tool of claim 6, wherein the threaded ring is split into at least two pieces and comprises at least one screw hole traversing the split of the two pieces.

8. The shock reduction tool of claim 6, wherein the UBHO muleshoe and the oriented shaft comprise corresponding spline sections that axially and radially overlap.

9. The shock reduction tool of claim 4, wherein the oriented shaft comprises outwardly facing splines radially and axially overlapping with inwardly facing splines on the oriented housing.

10. The shock reduction tool of claim 9, further comprising resilient chords disposed in gaps between the splines on the oriented shaft and the splines on the oriented housing.

11. The shock reduction tool of claim 10, further comprising ports in the oriented housing in fluid communication with the gaps between the splines on the oriented shaft and the splines on the oriented housing.

12. A tool string disposed in at least one tubular comprising upper and lower threaded connections to connect to a drill string, the tool string comprising:

a shock reduction tool comprising an anchoring tail piece axially and rotationally fixed to the at least one tubular;

a universal bore hole orientation (UBHO) muleshoe disposed at an upper end of the shock reduction tool; and a downhole electronics package coupled to the UBHO muleshoe;

wherein the UBHO muleshoe is configured to rotationally and axially orient the downhole electronics package within the at least one tubular.

13. The tool string of claim 12, wherein the shock reduction tool further comprises:

an orienting sleeve, wherein the orienting sleeve comprises a female angular orientation feature;

an oriented adapter rotationally fixed and axially movable with respect to the orienting sleeve, wherein the oriented adapter comprises a through bore and a male angular orientation feature adapted to the orienting sleeve; and a first spring disposed in an annular space between the oriented adapter and the orienting sleeve, wherein the spring is between a first shoulder that is axially fixed to the oriented adapter and a second shoulder that is axially fixed to the orienting sleeve, wherein one of the orienting sleeve and the orienting adapter is rotationally and axially fixed relative to the anchoring tail piece.

14. The tool string of claim 13, wherein the shock reduction tool further comprises:

a torsional shock reduction section, comprising, an oriented housing, and an oriented shaft rotationally movable by less than about 10 degrees with respect to the oriented housing, wherein one of the oriented shaft and the oriented housing is rotationally and axially fixed with respect to the oriented adapter.

15. The tool string of claim 13, wherein the torsional shock reduction section is disposed between the oriented adapter and the UBHO muleshoe.

16. The tool string of claim 15, wherein the UBHO muleshoe is axially fixed to the oriented shaft by a threaded ring disposed between two shoulders on the oriented shaft.

17. The tool string of claim 16, wherein the threaded ring is split into at least two pieces and comprises at least one screw hole traversing the split of the two pieces.

18. The tool string of claim 14, wherein the oriented shaft comprises outwardly facing splines radially and axially overlapping with inwardly facing splines on the oriented housing, and wherein the shock reduction tool further comprises resilient chords disposed in gaps between the splines on the oriented shaft and the splines on the oriented housing.

19. The tool string of claim 18, further comprising ports in the oriented housing in fluid communication with the gaps between the splines on the oriented shaft and the splines on the oriented housing.

20. The shock reduction tool of claim 13, further comprising a second spring configured to apply force in an opposing direction to the first spring.

21. A shock reduction tool for a downhole electronics package disposed within a tubular, comprising:

an oriented housing comprising a plurality of radially inwardly facing splines;

an oriented shaft rotationally movable by less than about 10 degrees with respect to the oriented housing and comprising a plurality of radially outwardly facing splines; and a universal bore hole orientation (UBHO) muleshoe disposed at an upper end of the oriented shaft, wherein the UBHO muleshoe is configured to rotationally and axially orient the downhole electronics package within the tubular;

wherein the plurality of radially inwardly facing splines on the oriented housing radially and axially overlap with the plurality of radially outwardly facing splines on the oriented shaft;

wherein a resilient material is disposed in gaps between the radially inwardly facing splines on the oriented housing and the radially outwardly facing splines on the oriented shaft; and wherein one of the oriented housing and the oriented shaft is rotationally fixed with respect to the tubular.

22. The shock reduction tool of claim 21, wherein the resilient material comprises a plurality of resilient chords or a cut O-ring.

23. The shock reduction tool of claim 22, wherein the resilient chords comprise one of RTV silicone, butyl rubber, urethane, and nitrile rubber.

* * * * *